US009927066B1

(12) United States Patent
Wonders

(10) Patent No.: US 9,927,066 B1
(45) **Date of Patent: *Mar. 27, 2018**

(54) FLUID FLOW INITIATED AND CONTROLLED AUTOMATIC SEQUENCING CASCADE SYSTEM FOR THE RECHARGING OF FLUID CYLINDERS

(71) Applicant: Scott Fredric Wonders, Port Arthur, TX (US)

(72) Inventor: Scott Fredric Wonders, Port Arthur, TX (US)

( * ) Notice: Subject to any disclaimer, the term of this patent is extended or adjusted under 35 U.S.C. 154(b) by 69 days.

This patent is subject to a terminal disclaimer.

(21) Appl. No.: 15/004,650

(22) Filed: Jan. 22, 2016

Related U.S. Application Data

(63) Continuation-in-part of application No. 13/066,601, filed on Apr. 19, 2011, now Pat. No. 9,243,753.

(60) Provisional application No. 61/400,862, filed on Aug. 4, 2010.

(51) Int. Cl.
*F17C 5/06* (2006.01)
*F17C 5/00* (2006.01)

(52) U.S. Cl.
CPC ..... *F17C 5/002* (2013.01); *F17C 5/06* (2013.01)

(58) Field of Classification Search
CPC .. F17C 5/002; F17C 5/06; F17C 13/02; F17C 2227/043
See application file for complete search history.

(56) References Cited

U.S. PATENT DOCUMENTS

| | | | | |
|---|---|---|---|---|
| 5,409,046 | A | 4/1995 | Swenson et al. | |
| 5,848,591 | A * | 12/1998 | Weismann | A61M 16/12 128/203.12 |
| 5,884,675 | A | 3/1999 | Krasnov | |
| 6,722,399 | B1 | 4/2004 | Cano | |
| 6,786,245 | B1 | 9/2004 | Eichelberger et al. | |
| 7,128,103 | B2 * | 10/2006 | Mitlitsky | H01M 8/04089 141/197 |
| 7,178,565 | B2 | 2/2007 | Eichelberger et al. | |
| 7,568,507 | B2 | 8/2009 | Farese et al. | |
| 7,823,609 | B2 | 11/2010 | Wonders | |
| 8,122,918 | B2 | 2/2012 | Handa | |
| 8,156,970 | B2 | 4/2012 | Farese et al. | |
| 8,286,675 | B2 | 10/2012 | Farese et al. | |
| 8,899,278 | B2 | 12/2014 | Cohen et al. | |
| 9,243,753 | B2 * | 1/2016 | Wonders | F17C 5/06 |
| 2005/0103400 | A1 | 5/2005 | Eichelberger et al. | |
| 2006/0260933 | A1 * | 11/2006 | Mitlitsky | H01M 8/04089 204/228.4 |
| 2006/0260950 | A1 * | 11/2006 | Mitlitsky | H01M 8/04089 205/637 |
| 2007/0051423 | A1 | 3/2007 | Handa | |
| 2007/0079891 | A1 | 4/2007 | Farese et al. | |
| 2007/0125441 | A1 | 6/2007 | Farese et al. | |
| 2008/0023100 | A1 | 1/2008 | Wonders | |

(Continued)

*Primary Examiner* — Nicolas A Arnett
(74) *Attorney, Agent, or Firm* — Buskop Law Group, P.C.; Wendy Buskop

(57) ABSTRACT

A system and method for recharging at least one fluid cylinder using a first fluid cylinder. The system uses a flow indicating switch which can comprise an internal magnetic source to detect the flow of fluid. The flow indicating switch is in communication with an electronic sequencing module. The electronic sequencing module controls the order and timing of discharge from the first fluid cylinder into the at least one fluid cylinder.

17 Claims, 6 Drawing Sheets

(56) References Cited

U.S. PATENT DOCUMENTS

| | | | | |
|---|---|---|---|---|
| 2009/0236006 | A1 | 9/2009 | Farese et al. | |
| 2009/0250138 | A1 | 10/2009 | Bavarian et al. | |
| 2011/0225986 | A1* | 9/2011 | Germond | F17C 9/02 62/50.2 |
| 2012/0031525 | A1* | 2/2012 | Wonders | F17C 5/06 141/4 |
| 2012/0168007 | A1 | 7/2012 | Wonders | |

* cited by examiner

FLUID FLOW INITIATED AND CONTROLLED AUTOMATIC SEQUENCING CASCADE SYSTEM FOR THE RECHARGING OF FLUID CYLINDERS

CROSS REFERENCE TO RELATED APPLICATION

The current application is a Continuation in Part of co-pending application Ser. No. 13/066,601 filed on Apr. 19, 2011, entitled "COMPRESSED GAS FLOW INITIATED AND CONTROLLED AUTOMATIC SEQUENCING CASCADE SYSTEM FOR THE RECHARGING OF COMPRESSED GAS CYLINDERS," which claims priority to and the benefit of U.S. Provisional Patent Application Ser. No. 61/400,862 filed on Aug. 4, 2010. These references are hereby incorporated in their entirety.

FIELD

The present embodiments generally relate to the recharging of compressed gas cylinders.

BACKGROUND

Cascade systems which are used to recharge compressed gas cylinders, such as that of a Fire Fighters SCBA (self-contained breathing apparatus) cylinder, Divers SCUBA (self-contained underwater breathing apparatus) or paint ball gun compress gas cylinder(s), are comprised of one or more bank(s) of compressed gas storage cylinders connected to a flow control panel with valves. The fluid cylinder valves are opened or closed to permit the compressed gas flow from the individual storage cylinder(s) "banks" or "stages" into the SCBA/SCUBA cylinder(s).

Sequence cascading the flow from the various individual storage cylinders beginning with the lowest pressure cylinder 1st then progressing to the next highest pressure cylinder will maximize the total number of compressed gas cylinders which can be recharged. These cascade systems can also be equipped with accessory items such as compressor(s), which are used to refill the storage cylinders, and/or containment fill enclosure(s) to protect the operator from injury in the event of a cylinder rupture while it is being recharged.

At the present time, there are two basic types of cascade systems control/fill panels available which are used for recharging compressed gas cylinders. The first is a manually operated cascade control/fill panel. The second is an automatic sequencing cascade (auto-cascade) control/fill panel.

Manually Operated Control Panel:

The basic operation of a manual cascade fill panel used to recharge a high pressure gas cylinder is relatively simple. One or more high pressure compressed gas cylinder(s) which needs to be recharged are connected to the cascade system on the downstream side of the control panel while the high pressure compressed gas storage cylinder(s) are connected upstream of the control panel. The various cascade storage cylinders (stages) are connected to manually operated valves within the cascade control panel. The downstream sides of these manual valves are connected together in such a way as to permit the discharge exiting any manual valve(s) to be transferred into the cylinder which is being recharged.

The fill panel operator first compares the pressure of the cylinder(s) which are being recharged to that of the storage cylinders stages. The operator then opens the panel valve to the storage cylinder which has the pressure differential which is closest to, but higher than that of the cylinder(s) which are being recharged. This will permit the compressed gas from this particular storage cylinder/stage to flow into the cylinder which is being recharged. When the pressure in the cylinder which is being recharged equalizes with that of the storage cylinder, the operator closes this valve. The operator then opens the next higher pressure storage cylinder control panel valve which will then permit the compressed gas from this storage cylinder/stage to flow into the cylinder(s) which are being recharged. This process will continue until the cylinder being recharged reaches its maximum designed working pressure or equalizes pressure with that of the highest pressure storage cylinder/stage. The manually controlled cascade system is a good system but requires extensive training to use and the operator must pay close attention during its use to maximize the fill potential available within the storage cylinders. Any deviation of the above listed procedure will greatly diminish that maximum fill potential of the cascade system.

Automatically Sequencing Control Panel:

The second type of cascade system is the auto-cascade fill panel. This system is very easy for an untrained operator to use. Also, this system does not require the constant attention by the operator. Once the operator initiates the fill sequence, the auto-cascade system will then control the fill sequence until the cylinder which is being recharged reaches its designed working pressure, equalizes with the highest pressure storage cylinder/stage or is stopped by the operator.

At the present time two types of auto-cascade fill panels available. Both types operate using the same principle of monitoring the pressures between the individual compressed gas storage cylinder(s) (banks) and that of the cylinder which is being recharged. As the pressure differentials between the cylinder(s) being recharged and individual fluid cylinder near equalization, either a pneumatic, hydraulic or electric valve is automatically opened to permit gas to flow from the next higher pressure fluid cylinder to flow into the cylinder which is being recharged.

The following is a more detailed example of a simple 2-stage pneumatically operated auto-cascade system which is based on present day technology.

Auto-Cascade Method #1:

The 1st auto-cascade method/devise is a mechanical/pneumatic system. The various physical pressures within the system are transferred through tubing to one or more sequencing valves. The sequencing valve is comprised of two parts. The first part is a mechanically actuated high pressure on/off valve. The second part is a pressure differential valve which is to the top of the first valve. The following example demonstrates the operation of a 2-stage auto-cascade system.

A sequence valve is placed on the 2nd stage (compressed gas storage cylinders) of the system. The pressure from the 1st stage storage cylinder will be transmitted to one side of the differential pressure valve which is installed on the 2nd stage storage cylinder. The pressure from the cylinder being recharged is transferred to the second side of this differential pressure valve. As long as the pressure differential on either side of this valve is above a predetermined psi, the mechanically activated on/off part of the sequence valve will remain closed thus permitting only the gas from the 1st stage compressed gas storage cylinders to be transferred into the cylinder which is being recharged.

When the pressure in the cylinder which is being recharged nears equalization with that of the 1st stage storage cylinder, the pressure differential valve, with the assistance of a bias pressure spring, will cause the differential valve piston to move downward toward the second on/off section of the sequence valve assembly. This mechanical movement will open the on/off valve section of the sequence valve of 2nd stage storage cylinder thus allowing gas from the 2nd stage storage cylinder to begin to flow into the cylinder which is being recharged.

This sequence will continue until: 1—The operator stops the fill process. 2—The pressure of the cylinder which is being recharged equalizes with that of the highest pressure storage cylinder. 3—The cylinder which is being recharged reaches its maximum rated working pressure.

Auto-Cascade Method #2:

The 2nd Auto-Cascade method/devise functions the same as the first method with one major exception. The pressure differential (sequence) valve(s) have been replaced with electric, electric over hydraulic or electric over pneumatic solenoid valve(s) and a computer, programmable logic circuit or peripheral interface controller which receives cascade system pressure information via electrical pressure transducers. The pressure transducers, which are located in various key areas of the system, electrically transmit pressure information to the computer or logic circuit. The computer or logic circuit program compares the pressure differential and then controls the discharge sequence of the compressed gas storage cylinder(s) into the cylinder(s) which are being recharged by opening electric, electric over pneumatic or electric over hydraulic solenoid valve(s) in the correct sequence and time as dictated by the pressure differentials.

While the above mentioned manual and automatic cascade systems function well, there are problems inherent to both designs.

Manual Cascade Problems:

The single most common problem with a manual cascade panel operation is the opening of a cascade system panel "Stage" block valve prematurely. This will lower the pressure in that specific stage. The premature discharge and subsequent decrease in the pressure of this stage will have a catastrophic effect on the overall system efficiency and reduce the number of available cylinder recharges.

Pressure Differential Auto-Cascade Problems:

The Pressure Differential based pneumatic auto-cascade system requires extensive tubing/plumbing to operate correctly. The complexity of this tubing/plumbing is costly to produce and prone to compressed gas leaks due to the numerous pipe/tubing connections which are required.

The Pressure Differential based electrical pressure transducer auto-cascade system requires the use of multiple pressure transducers, complicated wiring and sophisticated electronics, such as computer or PLC circuits to monitor pressures and control the fluid cylinder (stage) discharge sequence. This design is also costly to produce and prone to compressed gas leaks due to the numerous transducers to tubing connections which are required The present embodiments solve the above described issues.

BRIEF DESCRIPTION OF THE DRAWINGS

The detailed description will be better understood in conjunction with the accompanying drawings as follows.

Figure 1:
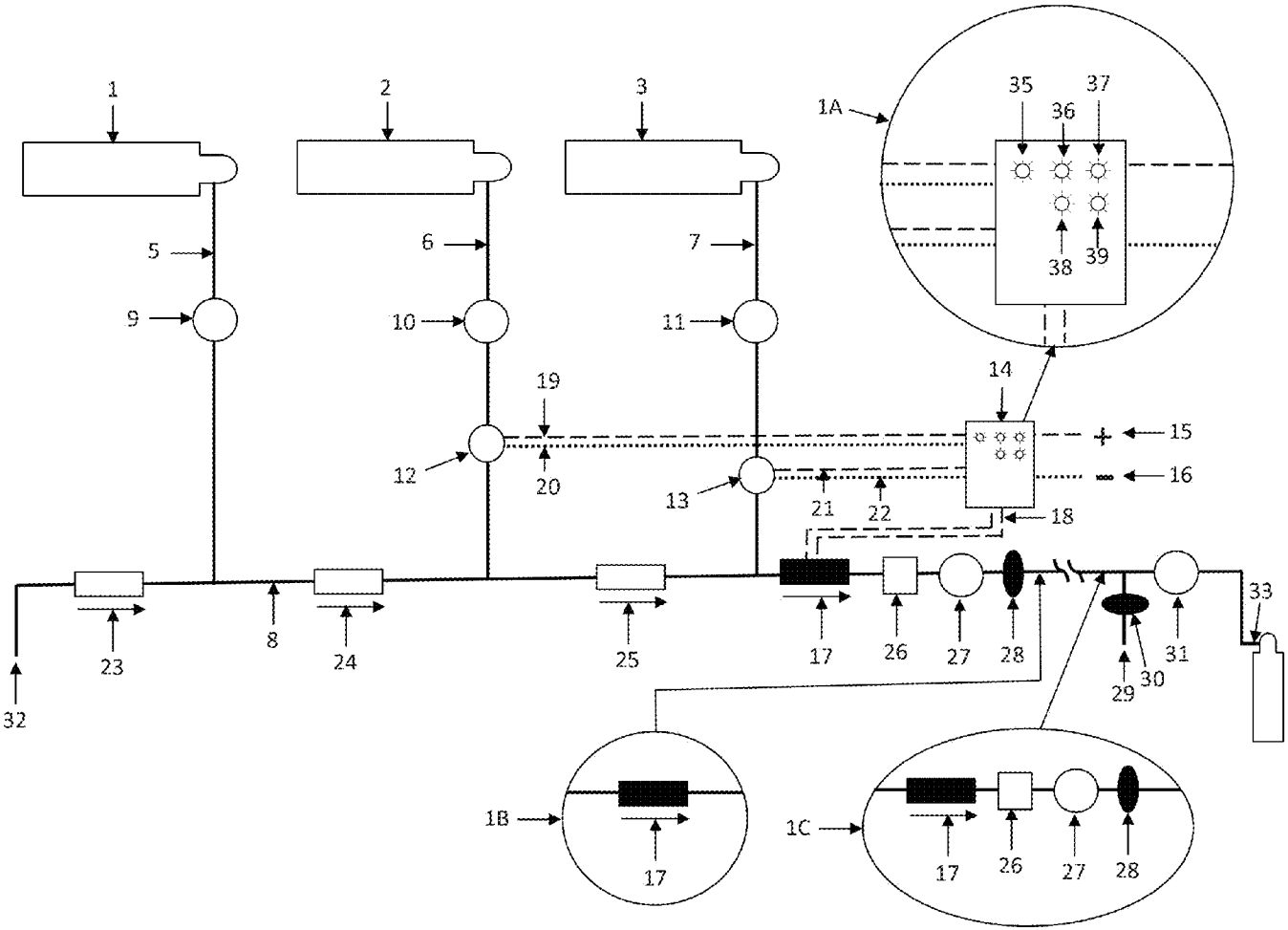
FIG. 1—Flow switch triggered auto-cascade tubing and electrical drawing with Back-Fill.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

Specific structural and functional details disclosed herein are not to be interpreted as limiting, but merely as a basis of the claims and as a representative basis for teaching persons having ordinary skill in the art to variously employ the present invention.

The present embodiments relate to a system for the automatic recharging of at least one fluid cylinder. While the examples below detail the filling of pressurized gas cylinders as a typical application of the invention, it should be understood that the system described can be used for any fluid, whether liquid, gas, gel, slurry, and the like.

Cylinder is used herein to refer to a container of fluid, and can apply to storage tanks, transportable cylinders, or other such fluid containers.

The invention concerns any fluid in a container, wherein it is desirable for the container to be periodically filled with fluid, or maintained at a desired fluid level, fluid volume, or fluid pressure.

The system can have at least one fluid cylinder to be filled or recharged. The at least one fluid cylinder is the container in which it is desirable to maintain a fluid level or fluid pressure.

One or more storage cylinders, such as a first fluid cylinder and a second fluid cylinder can be in communication with the at least one fluid cylinder for the purpose of supplying the at least one fluid cylinder with fluid.

The fluid cylinders can supplied by a single supply line, providing a distinct advantage over the current state of the art, which requires a separate line for each cylinder supplying fluid. In situations where a pneumatically controlled auto-cascade is used, two lines are actually needed for each storage cylinder, one for fill pressure and one for sensing line pressure.

One or more solenoid valves can be in communication with the first fluid cylinder, the at least one fluid cylinder, or both the first fluid cylinder and the at least one fluid cylinder. While this application refers to a solenoid valve, the intention is to describe any valve that can be controlled with an electrical signal. For example, a pneumatic valve with a control system that receives an electrical input would be considered a solenoid valve for the purposes of this invention.

In embodiments, the solenoid valve can be electric, electric over pneumatic, or electric over hydraulic.

The system can also have a flow indicating switch for detecting a flow of fluid. While many mechanical means exist for measuring or detecting fluid flow, the flow indicating switch can be any means of detecting or measuring a fluid flow within the system and transferring data via electronic communication.

In embodiments the flow indicating switch can be a mechanical switch that has an internal magnetic source which is displaced a predetermined distance when a fluid flow exceeds a minimal flow quantity. In other embodiments, the flow indicating switch can make or break an electrical circuit.

An electronic sequencing module can be in electronic communication with the flow indicating switch, wherein the electric sequencing module uses a signal from the flow indicating switch to operate the solenoid valve to control an order and a timing of discharge from the storage cylinder(s) into the at least one fluid cylinder.

In embodiments, the electronic sequencing module can maximize the number of times the at least one fluid cylinder is recharged by the storage cylinder(s) with a predetermined logic.

In other embodiments, the electronic sequencing module can provide a visual or audible reference indicating whether the solenoid valve is open or closed. For example, such a reference may be an alert tone, light, or signal to a distributed control system for display on a graphical interface.

The electronic sequencing module need not be a single unit. Various electronic portion of it may be distributed and located remotely to the at least one fluid cylinder as long as all components of the electronic sequencing module are in communication with each other, allowing it to operate as a single module or device. In the same manner, a portion of the flow indicating switch can be located remotely to the at least one fluid cylinder.

A back-up power source for providing power in the event of a power failure can be included. In embodiments, the back-up power source can be in communication with a means of charging the back-up power source.

The system can have a manually operated valve for use in the event that the solenoid valve fails. In embodiments, each of the storage cylinders can have their own valve.

In embodiments, the system can have a compressor for providing fluid, wherein the electronic sequencing module sequentially directs fluid. For example, the electronic sequencing module can direct fluid into the at least one fluid cylinder until a predetermined fluid pressure or fluid level is reached, at which time the electronic sequencing module then directs the fluid into a storage cylinder.

In alternative embodiments, the system can have a compressor for providing fluid, wherein the electronic sequencing module directs a portion of the fluid into the at least one fluid cylinder while simultaneously directing a portion of the fluid into the first fluid cylinder until a predetermined fluid pressure or fluid level is reached.

In embodiments, a portion of the system is attached to a firefighter breathing air replenishment system or other systems that require a self-contained breathing apparatus (SCBA).

A method of using the system for automatically recharging at least one fluid cylinder is as follows:

Using a first fluid cylinder to supply a fluid to the at least one fluid cylinder. Using a flow indicating switch to detect a flow of fluid. Generating an electronic signal with the flow indicating switch. Communicating the signal to an electronic sequencing module, wherein the electronic sequencing module operates a solenoid valve allowing fluid to flow from a first fluid cylinder to the at least one fluid cylinder.

This method is equally applicable to the various system embodiments described above.

Turning now to the Figures, FIG. 1 is a flow switch triggered auto-cascade tubing and electrical drawing with Back-Fill.

This figure demonstrates the operation of a 3-stage auto-cascade system with "Back-Fill" which uses the 17—FIS (High Pressure Flow Indicating Switch) as the key component which accurately controls the sequential discharge of compressed gas storage cylinders into compressed gas cylinder(s) which are being recharged. While this drawing demonstrates a 3-stage auto-cascade system controlled by the 17—FIS and 14—ESM (Electronic Sequencing Module) in actuality this configuration can control an infinite number of stages.

17—FIS Operation

The flow of a compressed gas through the 17—FIS (Flow Indicating Switch) displaces an internal magnetic source which will activate and/or deactivate an internal or external reed switch. The electric current or signal from the reed switch shall act as a trigger to initiate and control an ESM (Electric Sequencing Module) which in turn controls the automatic sequential discharge from 2 or more compressed gas storage cylinders into 1 or more cylinder(s) which are being recharging.

The 17—FIS (Flow Indicating Switch) has two functions in the below described system. Its primary function is to send an electrical signal to the 14—ESM when flow is passing though the 17—FIS. The secondary function of the 17—FIS is to act as a check valve in the event that pressure in the cylinder which is being recharged is higher than that of the compressed gas storage cylinders.

14—ESM Operation

The 14—ESM (Electronic Sequencing Model) has two operational states.

The 1st state is the "Stand-By" mode in which the 14—ESM is awaiting the initial signal from the 17—FIS which indicates flow is passing through the 17—FIS. While the 14—ESM is in stand-by mode, the 12 and 13—solenoid valves are in the "Fail-Safe" normally open position.

The 2nd state is the "Fill-Sequence" mode. This state is achieved when the 14—ESM in Stand-By mode receives the initial electrical current or signal from the 17—FIS which indicates that a compressed gas flow is passing through the 17—FIS. The initially signal from the 17—FIS places the 14—ESM in the Fill-Sequence mode which immediately closes the 12—2nd stage and 13—3rd stage solenoid valves. The 12—2nd stage and 13—3rd stage solenoid valves will remain closed until the electrical current or signal from the 17—FIS ceases. (This indicates that flow through the 17—FIS has stopped.) This will prompt the 14—ESM to sequence up to the next stage at which time the 14—ESM will open the 12—2nd stage solenoid valve.

Note: When in the Fill-Sequence mode the 14—ESM will be looking for one of two events to take place. The first event would be an electrical current or signal to be sent from the 17—FIS which will indicates that flow is present. The second event would be the expiration of the internal timer for the specific stage in the event that a "no flow" signal is sent by the 17—FIS. These two events shall cause the 14—ESM to hold the present solenoid valve(s) open or to open the next higher stage solenoid valve.

When the flow of compressed gas has stopped and the 14—ESM has sequenced through the last available stage, the 14—ESM will reset and return to Stand-By mode. Once in the Stand-By mode the 14—ESM will wait for next electrical current or signal from the 17—FIS which will re-initiate the Fill-Sequence mode.

A secondary function of the 14—ESM is demonstrated in the 1A—Subdrawing which shows the use of optional indicator lights which give the system operating personnel a visual reference of the status of each stage valve of the auto-cascade system. In this example we shall use green lights to signify that the stage valve(s) are open and yellow lights to signify that the stage valve(s) are in the closed position.

When in the 14—ESM enters the stand-by mode the 35, 36 and 37 green lights shall be lit indicating the 12 and 13—solenoide valves are open. NOTE: Due to the fact that the there is no solenoid valve on the 1—1st stage and this stage stays in the "open" position, the 35—1st stage green light will be connected to a positive wire and remain on at any time that an electrical current is being supplied to the auto-cascade system.

The instant flow begins passing through the 17—FIS an electrical current or signal is sent to the 14—ESM which initiates the 14—ESM. Once initiated the 14—ESM enters the Sequence-Fill mode causing the 36 and 37—green lights turn off and the 38 and 39—yellow lights turn on indicating the 12—2nd stage and 13—3rd stage solenoid valves are closed. As each of these solenoid valves are opened by the 14—ESM, the 36 and 37—green lights will turn on as their respective 38 and 39 yellow lights turn off.

NOTE: The ESM can derive its electrical power supply from any automotive type DC electrical source such as a 12 or 24 volt DC system or structural type AC power source such as 120 or 240 volt AC system. The ESM may also be equipped with an optional built in electrical charging circuit with a backup battery pack system which, in the event of a primary electrical source failure, would energize the FIS base Auto-Cascade system for a predetermined period of time. While this option could be used in any of the FIS controlled Auto-Cascade systems, it would be primarily beneficial when used in conjunction with a stationary or "Fixed Mount" system such as the FBARS which is discussed in further detail in the FIGS. 4 and 5 detailed descriptions.

Basic Compressed Gas Flow Through the Auto-Cascade System

Compressed gas from the 1—1st stage (low pressure) compressed gas storage cylinder(s) will flow downstream through 5—pipe or tubing into 8—pipe or tubing. The 9—pressure gauge can be used by personnel operating the cascade system to monitor the pressure in the 1—1st stage compressed gas storage cylinder(s).

Compressed gas from the 2—2nd stage (medium pressure) compressed gas storage cylinder(s) will flow downstream through 6—pipe or tubing and the normally open 12—solenoid valve into 8—pipe or tubing. The 10—pressure gauge can be used by personnel operating the cascade system to monitor the pressure in the 2—2nd stage compressed gas storage cylinder(s).

Compressed gas from the 3—3rd stage (high pressure) compressed gas storage cylinder(s) will flow downstream through 7—pipe or tubing and the normally open 13—solenoid valve into 8—pipe or tubing. The 11—pressure gauge can be used by personnel operating the cascade system to monitor the pressure in the 3—3rd stage compressed gas storage cylinder(s).

The 24—check valve on 8—pipe or tubing will prevent upstream flow from 8—tubing into the 1st stage components 9, 5 and 1. The 25—check valve on 8—pipe or tubing will prevent upstream flow from 8—tubing into the 2nd stage components 12, 10, 6, and 2. The 17—FIS check valve function on 8—pipe or tubing will prevent upstream flow from 33—cylinder which is being recharged into the 3nd stage components 13, 11, 7 and 3.

When the 28—block valve is in the closed position, there will be no compressed gas flow through the 17—FIS thus making it inactive.

NOTE: Solenoid valves mentioned throughout this document can be either electric, electric over pneumatic or electric over hydraulic. Also the solenoid valve configuration is designed in such a way as to provide a Fail-Safe (normally open) condition when there is no electrical current applied. This Fail-Safe configuration will enable the system to be used as a simple "bulk air" fill point in the event of a failure of any electrical components.

Auto-Cascade Operation:

An electrical current applied to the 15—positive and 16—negative wires or electrical connection points will energize the 14—ESM. Initially the 14—ESM will be in the Stand-By mode and no electrical current will pass through to the 12—2nd stage and 13—3rd stage solenoid valves. This places the 12—2nd stage and 13—3rd stage solenoid valves in their "Fail-Safe" normally open position.

One or more compressed gas cylinders which need to be refilled are connected to cascade system 33—outlet fitting. The valve(s) on the recharging cylinder(s) are opened completely. As the 28—block valve is opened, compressed gas from the 8—pipe or tubing will begin to flow through the 17—FIS and the 26—pressure regulator. The regulated pressure downstream of the 26—pressure regulator is monitored by the system operating personnel using 27—pressure gauge. Pressure downstream of the 28—fill valve (and the cylinder which is being recharged) is monitored by the 31—pressure gauge.

As gas flow through the 17—FIS reaches a predetermined minimum quantity the 17—FIS activates and electrical contacts of the 17—FIS close which send a signal to the 14—ESM via 18—electrical or fiber optic wires. This electrical signal will cause the 14—ESM to exit the stand-by mode and initiate the fill sequencing mode.

Once in the sequencing mode the 14—ESM will transmit an electrical current through the 19, 20, 21 and 22—electrical wires which will close the 12—2nd stage solenoid valve and the 13—3rd stage solenoid valve and, as illustrated in the 1A—subdrawing, activate the 38 and 39—LEDs and simultaneously deactivate their respective 39 and 39—LEDs. This initial electrical signal to the 14—ESM will also initiate an internal timing sequence with a predetermined expiration point.

If the flow of compressed gas from the 1—1st stage storage cylinder(s) through 8—pipe or tubing and through the 17—FIS is above the predetermined quantity, the 14—ECM will continue to hold the 12—2nd stage solenoid valve and the 13—3rd stage solenoid valve in the closed position thus permitting only compressed gas from the 1—1st stage storage cylinder(s) to flow into the 33—cylinder(s) which are being recharged.

If the flow of compressed gas from the 1—1st stage storage cylinder(s) through 8—pipe or tubing and through the 17—FIS is below the predetermined quantity and the predetermined no-flow time expires, the 14—ESM will open the 12—2nd stage solenoid valve, deactivate 38—LED, activate 36—LED and reset its internal timer. The 12—2nd stage solenoid valve shall remain open through the remainder of the fill sequence.

If flow is reestablished through the 17—FIS the 14—ESM will hold the 12—2nd stage solenoid valve open which will permit the compressed gas from the 2—2nd stage storage cylinder(s) to flow downstream and into the 33—cylinder(s) which are being recharged.

If the flow of compressed gas from the 2—2nd stage storage cylinder(s) through 8—pipe or tubing and through the 17—FIS is below the predetermined quantity and the predetermined no-flow time expires, the 14—ESM will open the 13—3rd stage solenoid valve, deactivate 39—LED, activate 37—LED and reset its internal timer. The 13—3rd stage solenoid valve shall remain open through the remainder of the fill sequence.

If flow is reestablished through the 17—FIS the 14—ESM will hold the 13—3rd stage solenoid valve open which will permit the compressed gas from the 3—3rd stage storage cylinder(s) to flow downstream and into the 33—cylinder(s) which are being recharged.

The above listed sequence shall continue until either, 1—the cylinder(s) which is being recharged has reached the desired pressure, 2—the cylinder(s) which is being recharged pressure equalizes with that of the highest pressure storage cylinder stage or 3—the system operating personnel manually stops the fill sequence. (Closes the 28—block valve)

Once the 14—ESM has sequenced through all available stages it shall automatically reset and go back into standby mode. At this point the 14—ESM will be ready to cycle through the fill sequence again once it receives the next initiating signal from the 17—FIS.

When the 33—cylinder(s) which are being recharged reach the desired pressure, the 33—cylinder valve and the 28—block valve are both closed. The 30—bleed valve is opened allowing the pressure which is captured between the 28—block valve and the 33—cylinder which is being recharged exit through the 29—bleed valve outlet. Once all pressure has been vented the 33—cylinder which is being recharged can be removed and replaced with the next cylinder which needs to be recharged.

1B—Subdrawing is an expanded view of the 17—FIS which shows an alternate placement of the 17—FIS. Due to the fact that the 17—FIS is responsible for the electrical current or signal which initiates and controls the 14—ESM, it may be placed at any single or multiple point(s) in the system downstream where the compressed gas flow from all compressed gas storage cylinders converge into a single pipe or tube.

1C—Subdrawing demonstrates an alternate valve assembly location. NOTE: The alternate location of the 17—FIS shown in 1B—Subdrawing can be used in the alternate valve assembly locations. The purpose of relocation of the entire valve assembly shown in the 1C—Subdrawing would be primarily for operations where the compressed gas storage cylinders and main auto-cascade valve assembly would be remote from the area(s) where the 33—cylinder(s) which are being recharged. An example of this would be a FBARS (Firefighter Breathing air Replenishment System) which will be discussed in further detail in FIG. 4.

A second example of 1B and 1C—subdrawing would be a mobile cascade system which is brought in when needed to supply the above listed FBARS with compressed gas.

A third example of the 1B and 1C—subdrawing would be where the auto-cascades storage cylinders and the auto-cascade valve assembly are located in areas of a structure or vehicle such as a trailer or Fire Truck which is remote to the SCBA fill station.

NOTE: When auto-cascade is used in conjunction with a Fire Fighters SCBA RIT (Rapid Intervention Team) or RIC (Rapid Intervention Crew) connection, the 30—bleed valve and/or the 28—block valve may be eliminated.

Back-Fill Operation:

Recharging of the 1, 2, and 3—compressed gas storage cylinders is accomplished by use of the patented Back-Fill system in which a compressor or alternate compress gas source is attached to the 32—Back-Fill inlet. As the outlet pressure of the compressor or alternate air source becomes equal to, or greater than, that of the pressure of the 1—1st stage storage cylinder(s) the compressed gas shall begin to flow through the 23—check valve and into the 1—1st stage storage cylinder(s).

When the outlet pressure of the compressor or alternate air source and the 1—1st stage storage cylinder(s) becomes equal to, or greater than that of the pressure of the 2—2nd stage storage cylinder(s), the compressed gas shall begin to flow through the 24—check valve and, due to its design, the 12—2nd stage solenoid valve and then into the 2—2nd stage storage cylinder(s). At this point the gas flow from the compressor or alternate air source shall be recharging the 1—1st and 2—2nd stage storage cylinders simultaneously at an equal rate of flow.

When the outlet pressure of the compressor or alternate air source and the 1—1st stage storage cylinder(s) and 2—2nd stage storage cylinder(s) becomes equal to or greater than that of the pressure of the 3—3rd stage storage cylinder(s), the compressed gas shall begin to flow through the 25—check valve and, due to its design, the 13—3rd stage solenoid valve and then into the 3—3rd stage storage cylinder(s). At this point the gas flow from the compressor or alternate air source shall be recharging the 1—1st, 2—2nd and 3—3rd stage storage cylinders simultaneously at an equal rate of flow. The compressed gas storage cylinders can be recharged with the Back-Fill system either during auto-cascade fill operations or after they are completed.

While this demonstrates the Back-Fill system used to recharge the storage cylinders of a 3-stage cascade system in actuality, the Back-Fill systems can be used to recharge the storage cylinders of a cascade system with an infinite number of stages and compressed gas storage cylinders.

Figure 2:
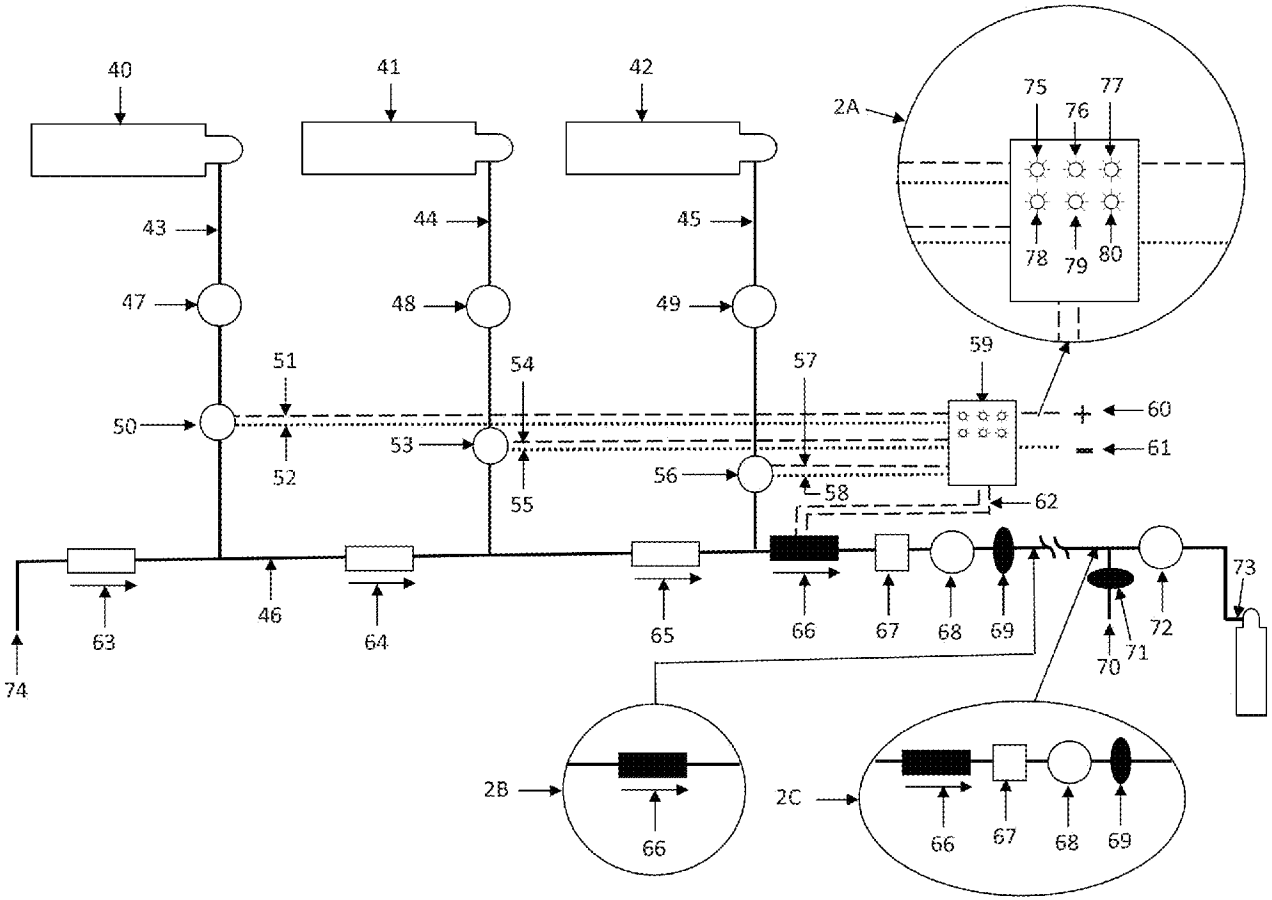
FIG. 2—Flow switch triggered auto-cascade tubing and electrical drawing with Priority-Fill.

FIG. 2 is a flow switch triggered auto-cascade tubing and electrical drawing with Priority-Fill.

This figure demonstrates the operation 3-stage auto-cascade system with "Priority-Fill" which uses the 66—FIS (High Pressure Flow Indicating Switch) as the key component that controls the sequential discharge of compressed gas storage cylinders into the compressed gas cylinder(s) which are being recharged. While this drawing demonstrates a 3-stage auto-cascade system controlled by the 66—FIS and 59—ESM (Electronic Sequencing Module) in actuality this configuration can control an infinite number of stages.

66—FIS Operation

The flow of a compressed gas through the 66—FIS (Flow Indicating Switch) displaces an internal magnetic source which will activate and/or deactivate an internal or external reed switch. The electric current or signal from the reed switch shall act as a trigger to initiate and control an ESM (Electric Sequencing Module) which in turn controls the automatic sequential discharge from 2 or more compressed gas storage cylinders into 1 or more cylinder(s) which are being recharging.

The 66—FIS (Flow Indicating Switch) has two functions in the below described system. Its primary function is to send an electrical signal to the 59—ESM when flow is passing though the 66—FIS. The secondary function of the 66—FIS is to act as a check valve in the event that pressure in the cylinder which is being recharged is higher than that of the compressed gas storage cylinders.

59—ESM Operation

The 59—ESM (Electronic Sequencing Model) has two operational states.

The 1st state is the Stand-By mode in which the 59—ESM is awaiting the initial signal from the 66—FIS which indicates that flow is passing through the 66—FIS. While in the standby mode the 50, 53 and 56—solenoid valves are in the "Fail-Safe" normally open position.

The 2nd state is the Fill-Sequence mode. This state is achieved when the 59—ESM in Stand-By mode receives the electrical current or signal from the 66—FIS which indicates that a compressed gas flow is passing through the 66—FIS. The initial signal from the 66—FIS places the 59—ESM in the Sequence-Fill mode which immediately closes the 50—1st stage, 53—2nd stage and 56—3rd stage solenoid valves. The 50—1st stage, 53—2nd stage and 56—3rd stage solenoid valves will remain closed until the electrical current or signal from the 66—FIS ceases. (This indicates that flow through the 66—FIS has stopped.) This will prompt the 59—ESM to sequence up to the next step at which time the 59—ESM will open the 50—1st stage solenoid valve.

Note: When in the Fill-Sequence mode the 59—ESM will be looking for one of two events to take place. The first event would be an electrical current or signal to be sent from the 66—FIS which will indicates that flow is present. The second event would be the expiration of the internal timer for the specific stage in the event that there is a "No Flow" signal from the 66—FIS. These two events shall cause the 59—ESM to hold the present solenoid valve open or to sequence up and open the next higher stage solenoid valve at which point the 59—ESM will close the preceding solenoid valve.

When the flow of compressed gas has stopped and the 59—ESM has sequenced through the last available stage, the 59—ESM will reset and return to Stand-By mode. Once in the Stand-By mode the 59—ESM will wait for next electrical current or signal from the 66—FIS which will re-initiate the Fill-Sequence mode.

A secondary function of the 59—ESM is demonstrated in the 2A—Subdrawing which shows the use of optional indicator lights which give the system operating personnel a visual reference of the status of each stage valve of the auto-cascade system. In the following example a green light will indicate that an individual solenoid valve is open while yellow light indicates that this solenoid valve is closed.

When in the 59—ESM enters the stand-by mode the 75, 76 and 77 green lights shall be lit. The instant that the 59—ESM enters the Sequence-Fill mode the 75, 76 and 77—green lights turn off and the 78, 79 and 80—yellow lights turn on indicating that the 50—1st stage, 53—2nd stage and 56—3rd stage solenoid valves are closed. As each of these solenoid valves are opened by the 59—ESM, the 75, 76 and 77—green lights will turn on as their respective 78, 79 and 80 yellow lights turn off.

NOTE: The ESM can derive its electrical power supply from any automotive type DC electrical source such as a 12 or 24 volt DC system or structural type AC power source such as 120 or 240 volt AC system. The ESM may also be equipped with an optional built in electrical charging circuit with a backup battery pack system which, in the event of a primary electrical source failure, would energize the FIS base Auto-Cascade system for a predetermined period of time. While this option could be used in any of the FIS controlled Auto-Cascade systems, it would be primarily beneficial when used in conjunction with a stationary or "Fixed Mount" system such as the FBARS which is discussed in further detail in the FIGS. 4 and 5 detailed descriptions.

Basic Compressed Gas Flow Through the Auto-Cascade System

Compressed gas from the 40—1st stage (low pressure) compressed gas storage cylinder(s) will flow downstream through 43—pipe or tubing and the normally open 50—solenoid valve then into 46—pipe or tubing. The 47—pressure gauge can be used by personnel operating the cascade system to monitor the pressure in the 40—1st stage storage compressed gas cylinder(s).

Compressed gas from the 41—2nd stage (medium pressure) compressed gas storage cylinder(s) will flow downstream through 44—pipe or tubing and the normally open 53—solenoid valve then into 46—pipe or tubing. The 48—pressure gauge can be used by personnel operating the cascade system to monitor the pressure in the 41—2nd stage compressed gas storage cylinder(s).

Compressed gas from the 42—3rd stage (high pressure) compressed gas storage cylinder(s) will flow downstream through 45—pipe or tubing and the normally open 56—solenoid valve then into 46—pipe or tubing. The 49—pressure gauge can be used by personnel operating the cascade system to monitor the pressure in the 42—3rd stage compressed gas storage cylinder(s).

The 64—check valve on 46—pipe or tubing will prevent upstream flow from 46—tubing into the 1st stage components 40, 43, 47 and 50. The 65—check valve on 46—pipe or tubing will prevent upstream flow from 46—tubing into the 2nd stage components 41, 44, 48 and 53. The 66—FIS check valve function on 46—pipe or tubing will prevent upstream flow from 73—cylinder which is being recharged into the 3rd stage components 42, 45, 49 and 56.

When the 69—block valve is in the closed position, there will be no compressed gas flow through the 66—FIS thus making it inactive.

NOTE: Solenoid valves mentioned throughout this document can be either electric, electric over pneumatic or electric over hydraulic. Also the solenoid valve configuration is designed in such a way as to provide a Fail-Safe (normally open) condition when there is no electrical current applied. This Fail-Safe configuration will enable the system to be used as a simple "bulk air" fill point in the event of a failure of any electrical components.

Auto-Cascade Operation:

NOTE: The operating principle of FIG. 2 closely mimics that of FIG. 1 with the exception of three items. These changes were necessary for the use of the "Hybrid Priority-Fill" system and method that FIG. 2 uses for recharging of its compressed gas storage cylinders. The three obvious changes are: 1—When closed the 50, 53 and 56—solenoid valves prevent pressure and/or gas from flowing either upstream or downstream. 2—When in Sequence-Fill mode only one solenoid valve at a time is open. 3—The 50—solenoid valve has been added in 43—pipe or tubing so that flow from the 40—1st stage compressed gas cylinder can be stopped from entering 46—pipe or tubing.

An electrical current applied to the 60—positive and 61—negative wires or electrical connection points will energize the 59—ESM. Initially the 59—ESM is in the Stand-By mode and no electrical current is passing through to the 50—1st stage, 53—2nd stage and 56—3rd stage solenoid valves. This places the 50—1st stage, 53—2nd stage and 56—3rd stage solenoid valves in their "Fail-Safe" normally open position.

One or more compressed gas cylinders which need to be refilled are connected to cascade system 73—outlet fitting. The valve(s) on the recharging cylinder(s) are opened completely. As the 69—block valve is opened, compressed gas from the 46—pipe or tubing will begin to flow through the 66—FIS and the 67—pressure regulator. The regulated pressure downstream of the 67—pressure regulator is monitored by the system operating personnel using 68—pressure gauge. Pressure downstream of the 69—fill valve (and the cylinder which is being recharged) is monitored by the 72—pressure gauge.

As gas flow through the 66—FIS reaches a predetermined minimum quantity, the 66—FIS activates and its electrical contacts close which send an electrical current or signal to the 59—ESM via 62—electrical or fiber optic wires. This electrical signal will cause the 59—ESM to exit the standby mode and initiate the sequence-fill mode.

Once in the sequence-fill mode the 59—ESM will transmit an electrical current through the 51, 52, 54, 55, 57 and 58—electrical wires which will close their respective 50—1st stage solenoid valve, 53—2nd stage solenoid valve and the 56—3rd stage solenoid valve and as illustrated in the 2A—Subdrawing, activate the 78, 79 and 80—LEDs. This electrical signal to the 59—ESM will also initiate an internal timing sequence with a predetermined expiration point.

NOTE: Obviously there will be no flow through the 66—FIS and into the 73—cylinder(s) which are being recharged since the 50—1st stage solenoid valve, 53—2nd stage solenoid valve and the 56—3rd stage solenoid valves are now in the closed position. At this point the closing of the 50—1st stage solenoid valve may seem to have no effect on the auto-cascade systems operation however; the importance of this step will be obvious as the "Hybrid Priority-Fill" operation is described at the end of the FIG. 2 detailed description.

Since the 50, 53 and 54—solenoid valves are closed and no flow of compressed gas will be passing through 46—pipe or tubing and through the 66—FIS, the back pressure will flow upstream from the 73—cylinder which is being recharged and be stopped by the check valve function of the 66—FIS. This "back pressure" will help in assuring that the 66—FIS will remain closed so the 59—ESM will then be able to rely solely on the internal timer for opening of the 50—1st stage solenoid valve.

When the 50—1st stage timer expires the 59—ESM will open the 50—1st stage solenoid valve. When this happens the 75—LED will activate and, in the same instant, the 78—LED will deactivate indicating that the 50—1st stage solenoid valve is open.

If flow is reestablished through the 66—FIS the 59—ESM will hold the 50—1st stage solenoid valve open which will permit the compressed gas from the 40—1st stage storage cylinder(s) to flow downstream into the 73—cylinder(s) which are being recharged.

If the flow of compressed gas from the 40—1st stage storage cylinder(s) through 46—pipe or tubing and through the 66—FIS is below the predetermined quantity and the predetermined no-flow time expires, the 59—ESM will close the 50—1st stage solenoid valve and open the 53—2nd stage solenoid valve simultaneously and reset the internal timer. When this happens the 75—LED will deactivate and, in the same instant, the 78—LED will activate indicating that the 50—1st stage solenoid valve is closed and the 76—LED will activate while the 79—LED deactivates indicating that the 50—2nd stage solenoid valve is open.

If flow is reestablished through the 66—FIS the 59—ESM will hold the 53—2nd stage solenoid valve open which will permit the compressed gas from the 41—2nd stage storage cylinder(s) to flow downstream into the 73—cylinder(s) which are being recharged.

If the flow of compressed gas from the 41—2nd stage storage cylinder(s) through 46—pipe or tubing and through the 66—FIS is below the predetermined quantity and the predetermined no-flow time expires, the 59—ESM will close the 53—2nd stage solenoid valve and open the 56—3rd stage solenoid valve simultaneously and reset the internal timer. When this happens the 76—LED will deactivate and, in the same instant, the 79—LED will activate indicating that the 53—2nd stage solenoid valve is closed and the 77—LED will activate while the 80—LED deactivates indicating that the 56—3rd stage solenoid valve is open.

If flow is reestablished through the 66—FIS the 59—ESM will hold the 56—3rd stage solenoid valve open which will permit the compressed gas from the 42—3rd stage storage cylinder(s) to flow downstream and into the 73—cylinder(s) which are being recharged.

The above listed sequence shall continue until either: 1—The cylinder(s) which are being recharged has reached the desired pressure. 2—The cylinder(s) which are being recharged pressure equalizes with that of the highest pressure storage cylinder stage. 3—The system operating personnel manually stops the fill sequence. (Closes the 69—block valve)

Once the 59—ESM has sequenced through all available stages it shall automatically reset and go back into standby mode. At this point the 59—ESM will be ready to cycle through the fill sequence again once it receives the next initiating signal from the 66—FIS.

When the 73—cylinder(s) which are being recharged reach the desired pressure, the 73—cylinder valve and the 69—block valve are both closed. The 71—bleed valve is opened allowing the pressure which is captured between the 69—block valve and 73—cylinder(s) which are being recharged to exit through the 70—bleed valve outlet. Once all pressure has been vented, the 73—cylinder which is being recharged can be removed and replaced with the next cylinder which needs to be recharged.

2B—Subdrawing is an expanded view of the 66—FIS indicates one alternate placement of the 66—FIS. Due to the fact that the 66—FIS is responsible for the electrical current or signal which initiates and controls the 59—ESM, it may be placed at a single or multiple point(s) in the system downstream of where the compressed gas flow from all compressed gas storage cylinders converge into a single pipe or tube.

2C—Subdrawing demonstrates an alternate valve assembly location. NOTE: The alternate location of the 66—FIS shown in 2B—Subdrawing can be used in the alternate valve assembly locations. The purpose of relocation of the entire valve assembly shown in the 2C—Subdrawing would be primarily for operations where the compressed gas storage cylinders and main auto-cascade valve assembly would be remotely located from the area(s) where the 69—block valve and the 73—cylinders which are being recharged. An example of this would be a FBARS (Firefighter Breathing air Replenishment System) which will be discussed in further detail in FIG. 4.

A second example of the 2B and 2C—subdrawing would be a mobile cascade system which is brought in when needed to supply the above listed FBARS with compressed gas.

A third example of the 2B and 2C—subdrawing would be where the auto-cascades storage cylinders and the auto-cascade valve assembly are located in areas of a structure or vehicle such as a trailer or Fire Truck which is remote to the SCBA fill station.

NOTE: When auto-cascade is used in conjunction with a Fire Fighters SCBA RIT (Rapid Intervention Team) or RIC (Rapid Intervention Crew) connections, the 71—bleed valve and/or the 69—block valve may be eliminated.

Hybrid Priority-Fill Operation:

Recharging of the 40, 41, and 42—compressed gas storage cylinders is accomplished by use of the patent pending Hybrid "Priority-Fill" method. The Hybrid Priority-Fill method is a combination of the industry standard Priority-Fill method combined with features of the patented "Back-Fill" method. The hybrid Priority-Fill system has 2 distinctive operating methods. The 1st method operates when the 59—ESM is in the Stand-By mode. The 2nd method operates when the 59—ESM is in Sequence-Fill mode.

"Stand-by" Mode:

When only recharging of the 40—1rst stage compressed gas cylinder(s), 41—2nd stage compressed gas cylinder(s), and 42—3rd stage compressed gas cylinder(s) is desired and the 69—fill/block valve is closed, the 59—ESM will enter the standby mode and open the 50, 53 and 56 solenoid valves. At this point the Hybrid Priority-Fill system and method will go into operation as a "Back-Fill system and method.

Example 1

In this instant a compressor or alternate compress gas source is attached to the 74—Priority-Fill inlet. As the outlet pressure of the compressor or alternate air source becomes equal to, or greater than, that of the pressure of the 40—1st stage storage cylinder(s) the compressed gas shall begin to flow through the 63—check valve, 50—1st stage solenoid valve and into the 40—1st stage storage cylinder(s).

When the outlet pressure of the compressor or alternate air source and the 40—1st stage storage cylinder(s) becomes equal to, or greater than that of the pressure of the 41—2nd stage storage cylinder(s), the compressed gas shall begin to flow through the 64—check valve and the 53—2nd stage solenoid valve and then into the 2—2nd stage storage cylinder(s). At this point the gas flow from the compressor or alternate air source shall be recharging the 40—1st and 41—2nd stage storage cylinders simultaneously at an equal rate of flow.

When the outlet pressure of the compressor or alternate air source and the 40—1st stage storage cylinder(s) and 41—2nd stage storage cylinder(s) becomes equal to or greater than that of the pressure of the 42—3rd stage storage cylinder(s), the compressed gas shall begin to flow through the 65—check valve and the 56—3rd stage solenoid valve and then into the 42—3rd stage storage cylinder(s). At this point the gas flow from the compressor or alternate air source shall be recharging the 40—1st, 41—2nd and 42—3rd stage storage cylinders simultaneously at an equal rate of flow.

"Sequence-Fill" Mode:

When in Sequence-Fill mode the "Priority-Fill" system and method is active, and the compressor or alternate air source output is above the predetermined volume of flow required to activate the 66—FIS, the compressors output will flow solely into the 73—cylinder which is being recharged.

When in the Sequence-Fill mode the "Priority-Fill" system and method are active, and the compressor or alternate air source output is below the predetermined volume of flow required to activate the 66—FIS, the compressors output flow will "Track" the 73—cylinder which is being recharged through the entire fill sequence. While this "Tracking" is taking place the compressor or alternate air source output will only flow into the 73—cylinder which is being recharged and the single stage of the compressed gas storage cylinder(s) which is open at that specific time. The "Tracking" of the 73—cylinder which is being recharged enables the compressor or alternate air source to maintain only enough pressure to achieve the recharge operation while enabling the system pressure to build quickly so that it always will remain equal to, or greater than, that of the 73—cylinder which is being recharged. This process will take advantage of the compressors higher recovery rate which is inherent when operating at lower pressures while at the same time giving the compressor the ability to utilize its maximum pressure capacity when needed.

Example #1

The following example will describe the Hybrid Priority-Fill method and system when used with a 3-stage auto-cascade where the "Sequence-Fill" and "Priority-Fill" operations are initiated simultaneously.

The compressor or alternate compress gas source is attached to the 74—Priority-Fill inlet. Flow passing through the 66—FIS will trigger the initiation of the 59—ESM which will close 50, 53 and 56 solenoid valves. As the outlet flow/pressure of the compressor or alternate air source becomes equal to, or greater than, that of the pressure within 46—pipe or tubing upstream of the 63—check valve the compressor output will begin to flow to the path of least resistance. Initially this path would be through the 63, 64, 65—check valves and the 66—FIS then into the 73—cylinder which is being recharged.

If the rate of flow remains above the minimum required to activate the 66—FIS, The 59—ESM will continue to hold closed 50, 53 and 56—solenoid valves and the compressor output will continue to flow through 46—pipe or tubing and past the 66—FIS then solely into the 73—cylinder which is being recharged until the 73—cylinder which is being recharged achieves the desired pressure.

If the rate of flow falls below the minimum required to maintain activation of the 66—FIS, the 59—ESM will open the 50—1st stage solenoid valve. As the outlet flow/pressure of the compressor or alternate air source becomes equal to, or greater than, that of the pressure within 46—pipe or tubing upstream of the 63—check valve the compressor output will begin to flow to the path of least resistance. Since the 50—1st stage solenoid valve is open, flow from the 40—1st stage fluid cylinder along with that of the compressor or alternate air source output will jointly flow through the 46—pipe or tube, 64—check valve, 65—check valve 66—FIS and into the 73—cylinder which is being recharged.

If the rate of flow remains above the minimum required to activate the 66—FIS, the 59—ESM will continue to hold closed the 53 and 56—solenoid valves allowing flow from the 40—1st stage fluid cylinder along with that of the compressor or alternate air source output will jointly flow through the 46—pipe or tube, 64—check valve, 65—check valve 66—FIS and into the 73—cylinder which is being recharged until the 73—cylinder which is being recharged achieves the desired pressure.

If the rate of flow falls below the minimum required to maintain activation of the 66—FIS, the 59—ESM will close the 50—1st stage solenoid valve and open the 53—2nd stage solenoid valve. As the outlet flow/pressure of the compressor or alternate air source becomes equal to, or greater than, that of the pressure within 46—pipe or tubing upstream of the 64—check valve the compressor output will begin to flow to the path of least resistance. Since the 53—2nd stage solenoid valve is open, flow from the 41—2nd stage fluid cylinder along with that of the compressor or alternate air source output will jointly flow through the 46—pipe or tube, appropriate check valves, the 66—FIS and into the 73—cylinder which is being recharged.

If the rate of flow remains above the minimum required to activate the 66—FIS, The 59—ESM will continue to hold closed the 50—1st stage and 56—3rd stage solenoid valves allowing flow from the 41—2nd stage fluid cylinder along with that of the compressor or alternate air source output will jointly flow through the 46—pipe or tube, 64—check valve, appropriate check valves, the 66—FIS and into the 73—cylinder which is being recharged until the 73—cylinder which is being recharged until it achieves the desired pressure.

If the rate of flow falls below the minimum required to maintain activation of the 66—FIS, the 59—ESM will close the 53—2nd stage solenoid valve and open the 56—3rd stage solenoid valve. As the outlet flow/pressure of the compressor or alternate air source becomes equal to, or greater than, that of the pressure within 46—pipe or tubing upstream of the 65—check valve the compressor output will begin to flow to the path of least resistance. Since the 56—3rd stage solenoid valve is open, flow from the 42—3rd stage fluid cylinder along with that of the compressor or alternate air source output will jointly flow through the 46—pipe or tube, appropriate check valves, the 66—FIS and into the 73—cylinder which is being recharged.

If the rate of flow remains above the minimum required to activate the 66—FIS, The 59—ESM will continue to hold closed the 50—1st stage and 53—2nd stage solenoid valves allowing flow from the 41—2nd stage fluid cylinder along with that of the compressor or alternate air source output will jointly flow through the 46—pipe or tube, 65—check valve, appropriate check valves, the 66—FIS and into the 73—cylinder which is being recharged until the 73—cylinder which is being recharged until it achieves the desired pressure.

The flow process will continue until the 73—cylinder which is being recharged either achieves the desired pressure or the fill process is stopped by personnel operating the Auto-Cascade system.

Example #2

The following example will describe the Hybrid Priority-Fill method and system when used with a 3-stage auto-cascade where the "Sequence-Fill" and "Priority-Fill" operations have already began and compressed gas is flowing from the 41—2nd stage fluid cylinder and into the 73—cylinder which is being recharged. The compressor or alternate compress gas source is attached to the 74—Priority-Fill inlet.

When the pressure from the compressor or alternate air source becomes equal to, or greater than that of the pressure in the 46—pipe or tube upstream of the 64—check valve, it will begin to flow past the 64 check valve and then jointly with that of the compressor or alternate air source output.

If the rate of flow remains above the minimum required to activate the 66—FIS, The 59—ESM will continue to hold closed the 50—1st stage and 56—3rd stage solenoid valves allowing flow from the 41—2nd stage fluid cylinder along with that of the compressor or alternate air source output will jointly flow through the 46—pipe or tube, 64—check valve, appropriate check valves, the 66—FIS and into the 73—cylinder which is being recharged until the 73—cylinder which is being recharged until it achieves the desired pressure.

If the rate of flow falls below the minimum required to maintain activation of the 66—FIS, the 59—ESM will close the 53—2nd stage solenoid valve and open the 56—3rd stage solenoid valve. As the outlet flow/pressure of the compressor or alternate air source becomes equal to, or greater than, that of the pressure within 46—pipe or tubing upstream of the 65—check valve the compressor output will begin to flow to the path of least resistance. Since the 56—3rd stage solenoid valve is open, flow from the 42—3rd stage fluid cylinder along with that of the compressor or alternate air source output will jointly flow through the 46—pipe or tube, appropriate check valves, the 66—FIS and into the 73—cylinder which is being recharged.

The flow process will continue until the 73—cylinder which is being recharged either achieves the desired pressure or the fill process is stopped by personnel operating the Auto-Cascade system.

NOTE: While these 2 examples describe the Hybrid Priority-Fill system and method as used on a 3-stage Auto-Cascade system, in actuality, an infinite number of stages may be used.

Figure 3:
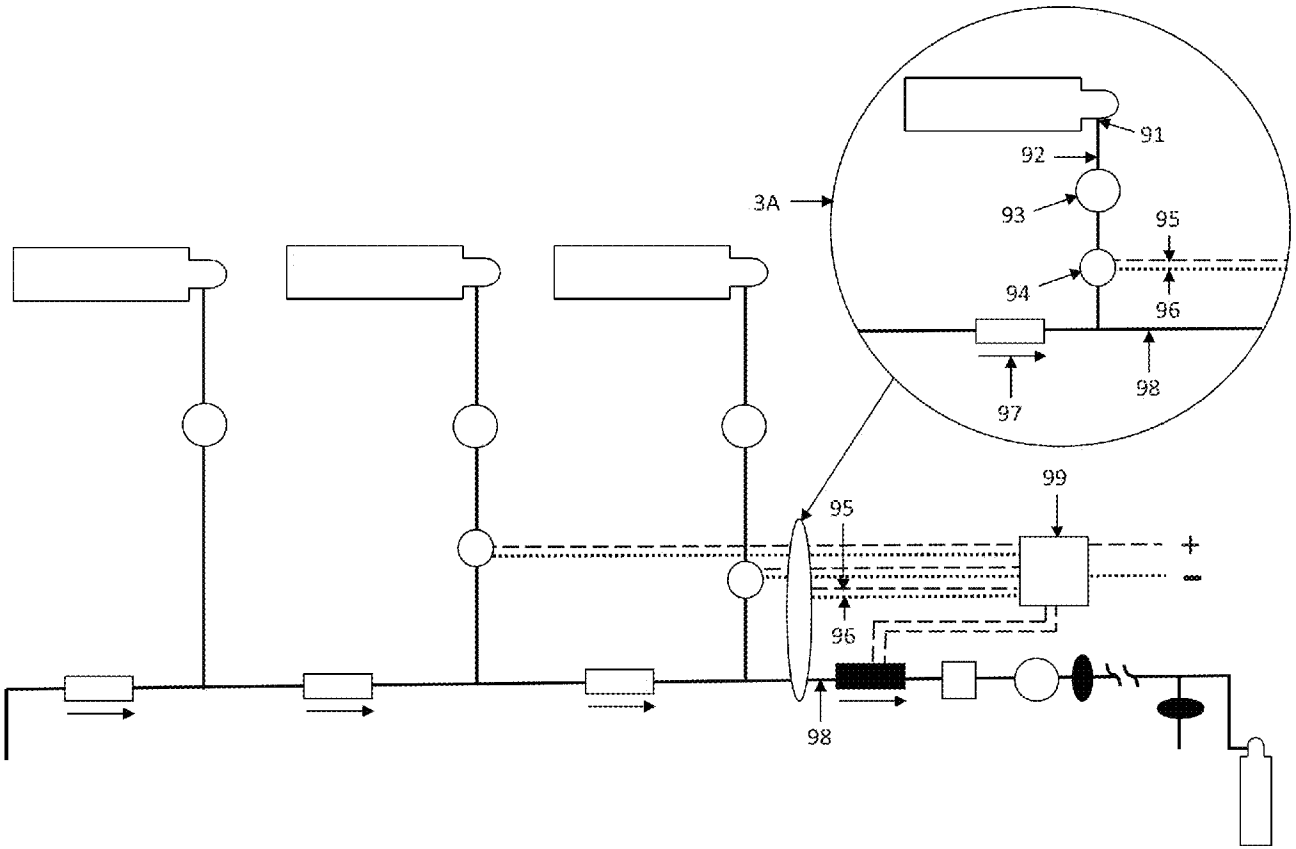
FIG. 3—Valve sub-assembly schematic used to install additional stage(s) in the Back-Fill or Priority-Fill auto-cascade systems.

FIG. 3 is a valve sub-assembly schematic used to install additional stage(s) in the Back-Fill or Priority-Fill auto-cascade systems.

This figure demonstrates how one or more of the valve sub-assemblies as seen in the 3A—subdrawing can be installed to add additional stage(s) into either the Back-Fill or Priority-Fill Flow Indicating Switch based auto-cascade systems.

The valve assembly described in the 3A—subdrawing consists of the 91—compressed gas storage cylinder(s) inlet, 92—interconnecting pipe or tube, 93—pressure gauge, 94—solenoid valve, 95 and 96—electrical wires, 97—check valve and the 98—pipe or tubing.

FIG. 3 shows the main system connection points the components listed in the 3A-subdrawing will connect to such as the 98—pipe or tubing, 95 and 96—electrical wires.

If the number of added valve sub-assemblies exceed the available connection points of the PCB (printed circuit boards) within the 99—ESM, additional auto-cascade PCB(s) can be connected in series and installed within the 99—ESM to allow for the infinite expansion of the number of auto-cascade stages.

Figure 4:
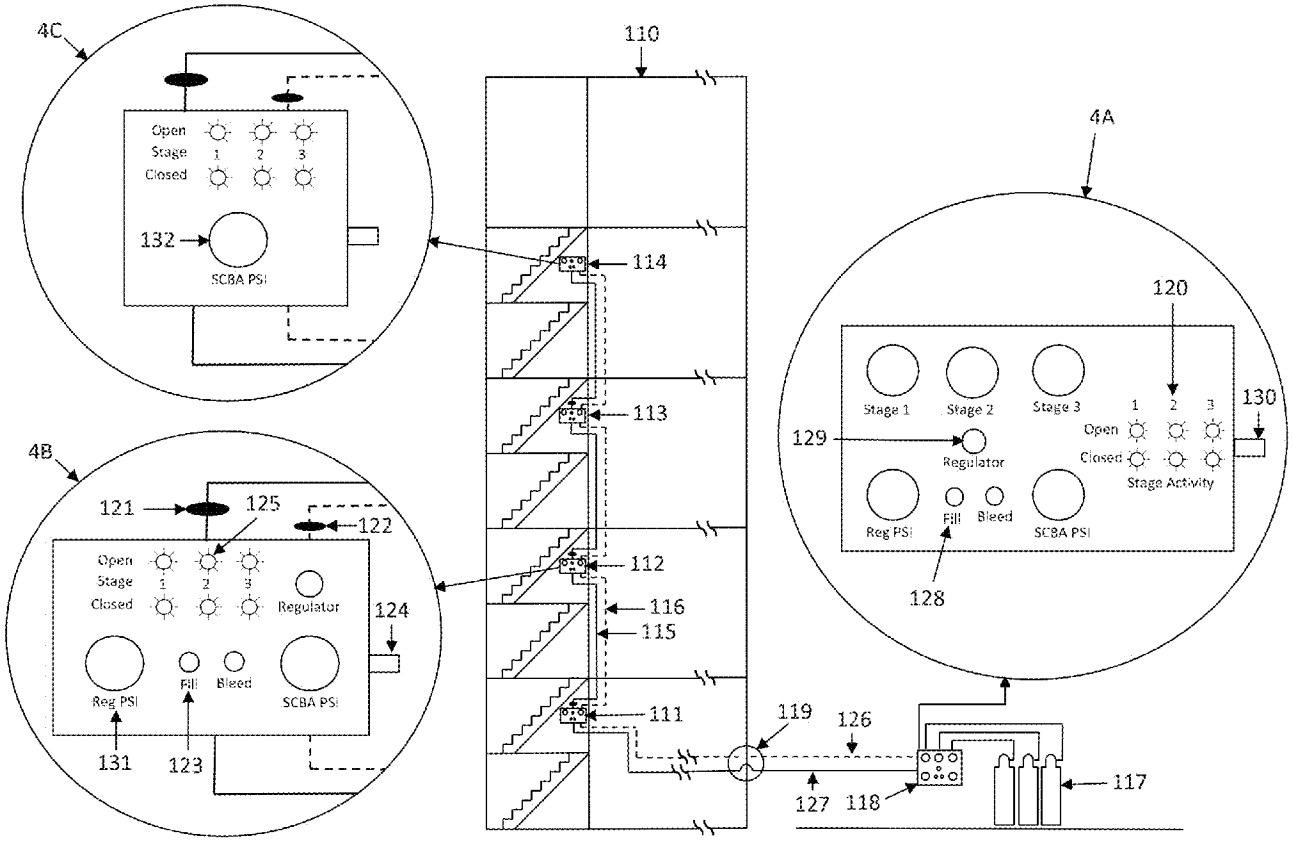
FIG. 4—Flow switch triggered auto-cascade demonstrated supplying Firefighters Breathing Air Replenishment System (FBARS).

FIG. 4 is a flow switch triggered auto-cascade demonstrated supplying Firefighters Breathing Air Replenishment System (FBARS).

This figure demonstrates the Single FIS (Flow Indicating Switch) based auto-cascade system when the applied use is to provide Auto-Cascade refilling of Fire Fighters SCBA using a "Firefighter Breathing Air Replenishment System" (FBARS) The FBARS requirements are set forth in the International Association of Plumbing and Mechanical Officials (IAPMO) documentation.

The FIS (Flow Indicating Switch) controlled Auto-Cascading systems, as discussed in the FIG. 1 and FIG. 2 detailed descriptions, is designed to function as intended when used in conjunction with the FBARS. A stationary Flow Indicating Switch (FIS) controlled Auto-Cascade used in conjunction with a bank of compressed gas storage cylinders can be permanently installed within a structure to provide compressed breathing air to the structures FBARS panel(s). An alternate to the permanently mounted FIS controlled Auto-Cascade system would be a Mobile (truck or trailer mounted) Flow Indicating Switch (FIS) controlled Auto-Cascade used in conjunction with a bank of compressed gas storage cylinders which would connect to the FBARS 119—Fire Department connection point on the structure to provide compressed breathing air to the structures FBARS panel(s).

Basic Component Description:

In the FIG. 4 design, the compressed gas supply needed at each of the 111, 112 and 113—FBARS panels will originate at the 118—primary fill panel then flow through the 127—compressor outlet pipe or tube and then be discharged into the structures 115—compressed gas pipe or tube at the 119—Fire Department connection point. The flow exiting the 118—primary fill panel will pass through a single FIS installed within, or in close proximity, to the primary fill panel.

The FIS will send an electrical current or signal to the ESM (Electronic Sequencing Module), any time the flow of compressed gas flow through the FIS exceeds a minimum predetermined quantity. The ESM will interpret this electrical current or signal and then open or close solenoid valves as required any time a SCBA cylinder is being recharged at one of the remote FBARS panels.

The 4A—subdrawing show expanded details of the 118—primary fill panel while the 4B and 4C—subdrawings show expanded details of two different styles of individual FBARS panels.

The individual 111, 112, 113 and 114—FBARS panels are interconnected with the 115—compressed gas distribution pipe or tubing. The FBARS panels may be equipped with an optional 121—isolation block valve which, when closed, will isolate the compress gas feed to all FBARS panels which are located above or distal to the 121—isolation block valve. The FBARS panels may also be equipped with an optional 116—wire bundle which is used to transmit an electric current or signal from the 118—primary fill panel which will enable the individual FBARS panel 125—visual indication of stage activity lights or readout to mimic that of the 118—primary panel 120—visual indication of stage activity lights or readout. An optional 122—wire bundle disconnect should be installed on each of the FBARS panels which, when opened, will isolate the electrical feed to all FBARS panels which are located above or distal to the 122—wire bundle disconnect.

FBARS Function when Used with a Mobile FIS Controlled Auto-Cascade System:

While both the stationary permanently installed or "Fix Mount" and the Mobile FIS controlled Auto-Cascade system functions identically when used in conjunction with the FBARS, in the following example a mobile type cascade will be used.

Example

A fire has occurred on the 4th floor of a 5 story structure. A Mobile FIS controlled Auto-Cascade system has been brought in to supply compressed breathing air to the structures FBARS.

The 126—wire bundle and the 127—pipe or tubing supplying compressed gas from the mobile cascade systems 118—primary fill panel are attached to their corresponding 116—wire bundle and 115—compressed gas distribution pipe or tubing at the structures 119—Fire Department connection point.

If the Fire Fighters or Rescue Personnel arriving on the 3rd floor of the structure suspect that the 114—FBARS panel, 115—FBARS compressed gas distribution pipe or tubing and/or the 116—wire bundle on the 4th floor has been damaged by fire, explosion or other malfunction, the Fire Fighter(s) will close the FBARS 121—isolation valve and open the 122—wire bundle disconnect which is located directly above the 113—FBARS thus isolating the FBARS components which are located on the 4th floor. The Fire Fighter or Rescue Personnel then notify the Incident Commander that the 110—structure FBARS is ready for operation. The Incident Commander then notifies the Cascade system operator who will then open the 118—primary fill panel 128—fill valve.

Opening the 118—primary fill panel 128—fill valve will pressurize the 115—compressed gas distribution pipe or tube via the 127—pipe or tubing thus pressurizing the 111, 112 and 113—FBARS panels. At the same time of pressurization, the optional 116—wire bundle will receive an electric current or signal from the 118—primary fill panel via the 126—wire bundle which will enable the individual 111, 112 and 113—FBARS panels 125—visual indication of stage activity lights or readout to mimic that of the 118—primary panel 120—visual indication of stage activity lights or readout.

The initial flow of compressed gas through the 118—primary panel FIS, will initiate an electrical current or signal which will activate the ESM and initiate the fill sequence program. As the pressure within the 115—distribution pipe or tubing equalizes with that of the pressure output of the 118—primary fill panel and compressed gas flow volume drops below a predetermined quantity, the ESM will go into the "Stand-By" mode. At the same time an electrical current or signal from the ESM will travel through the 126—wire bundle, into the 116—wire bundle and activate the active/operational FBARS panel 125—visual indicator of stage activity lights or readout. The 125—visual indicator of stage activity will, at this point, indicate that all solenoid valves are in the open position which will indicate that the ESM is in "Stand-By" mode.

When a Fire Fighter within the fire structure needs to recharge their Self Contained Breathing Apparatus (SCBA), the SCBA cylinder(s) is attached to the 124—SCBA connection point of any of the active/operational FBARS panels. NOTE: The connection method used should comply with industry accepted methods such as a "quick fill" connection, a commercially fabricated "Fill enclosure" or the Fire Fighters SCBA "RIT" (Rapid Intervention Team) or "RIC" (Rapid Intervention Crew) fittings, if the situation so necessitates.

When a SCBA cylinder is connected to a FBARS panel 124—SCBA connection point and the 123—fill valve is opened compressed gas from the 115—compressed gas distribution pipe or tube will begin to flow through the FBARS panel and into the SCBA cylinder(s) which is being recharged. As compressed gas begins to flow into the SCBA cylinder(s) which are being recharged, pressure within the 115—compressed gas distribution pipe or tube will begin to drop. This pressure drop will cause flow from the 118—primary fill panel to begin as the 118—primary fill panel 129—pressure regulator attempts to maintain a consistent pressure within the FBARS 115—compressed gas distribution pipe or tube.

This compressed gas flow through the FIS, which is installed in the 118—primary fill panel, will initiate the ESM which will now go into "Sequence-Fill" mode. At this point the FIS controlled Auto-Cascade shall operate as described in the FIG. 1 and FIG. 2 detailed descriptions of this document.

NOTE 1: The Fire Fighter performing SCBA fill operation using any of the FBARS panel may use the optional

125—visual indication of stage activity to determine if other FBARS panels are in use and, if so, which stage the FIS controlled Auto-Cascade is in at any specific point in time. This information combined with the FBARS panel 131—regulated pressure gauge and the SCBA pressure gauge will provide vital information to the Fire Fighter performing the SCBA recharge operation. The visual indication of stage activity will also visible to the operator that is monitoring the 118—primary fill panel 120—visual indicator of stage activity. This information will help the operator of the 118—primary panel determine the approximate numbers of SCBA recharges which are taking place and the total rate of breathing air consumption. This information will assist the 118—primary panel operator in determining whether there is a sufficient quantity of compressed gas on scene for the duration of the incident or if additional compressed gas will be required to complete the operation.

NOTE 2: Since the active/operational 111, 112 and 113—FBARS panels function as a remote extension of the 118—primary fill panel. The 118—primary fill panel operator's sole purpose will be to monitor the system and initiate either the Back-Fill or Hybrid Priority-Fill procedure in the event that the 117—fluid cylinder pressures are depleted to a predetermined pressure.

NOTE 3: The 118—primary fill panel shall remain fully operational for use by exterior Fire/Rescue personnel. Since the FIS controlled Auto-Cascade system functions by compressed gas "Flow" through the system, SCBA cylinder(s) can be recharged directly from the 118—primary fill panel 130—ground level SCBA fill point.

In the case where the Auto-Cascade system Sequence-Fill mode has already been initiated, and a second or third SCBA cylinder fill is initiated at another location in the system, the ESM will "hold" the Auto-Cascade system in the fill stage which it was in when the additional SCBA cylinder was attached. The ESM will continue to hold the Auto-Cascade in this stage until the SCBA cylinder pressures equalizes. When the two SCBA cylinders pressure equalize and the flow of compressed gas through the FIS drops to a predetermined quantity, the ESM shall initiate and continue the remainder of the fill sequence.

Optional FBARS Panel Design:

NOTE 1: The 4C—subdrawing demonstrate an alternate FBARS panel design where the pressure regulator has been omitted. When this design of FBARS panel is used, the FBARS panel discharge pressure is set solely by use of the 118—primary panel 129—pressure regulator.

NOTE 2: If FBARS panels are used in conjunction with a Fire Fighters SCBA "RIT" (Rapid Intervention Team) or "RIC" (Rapid Intervention Crew) fittings and local codes and regulations permit, the FBARS panel "Fill" and "Bleed" valve may be omitted.

Figure 5:
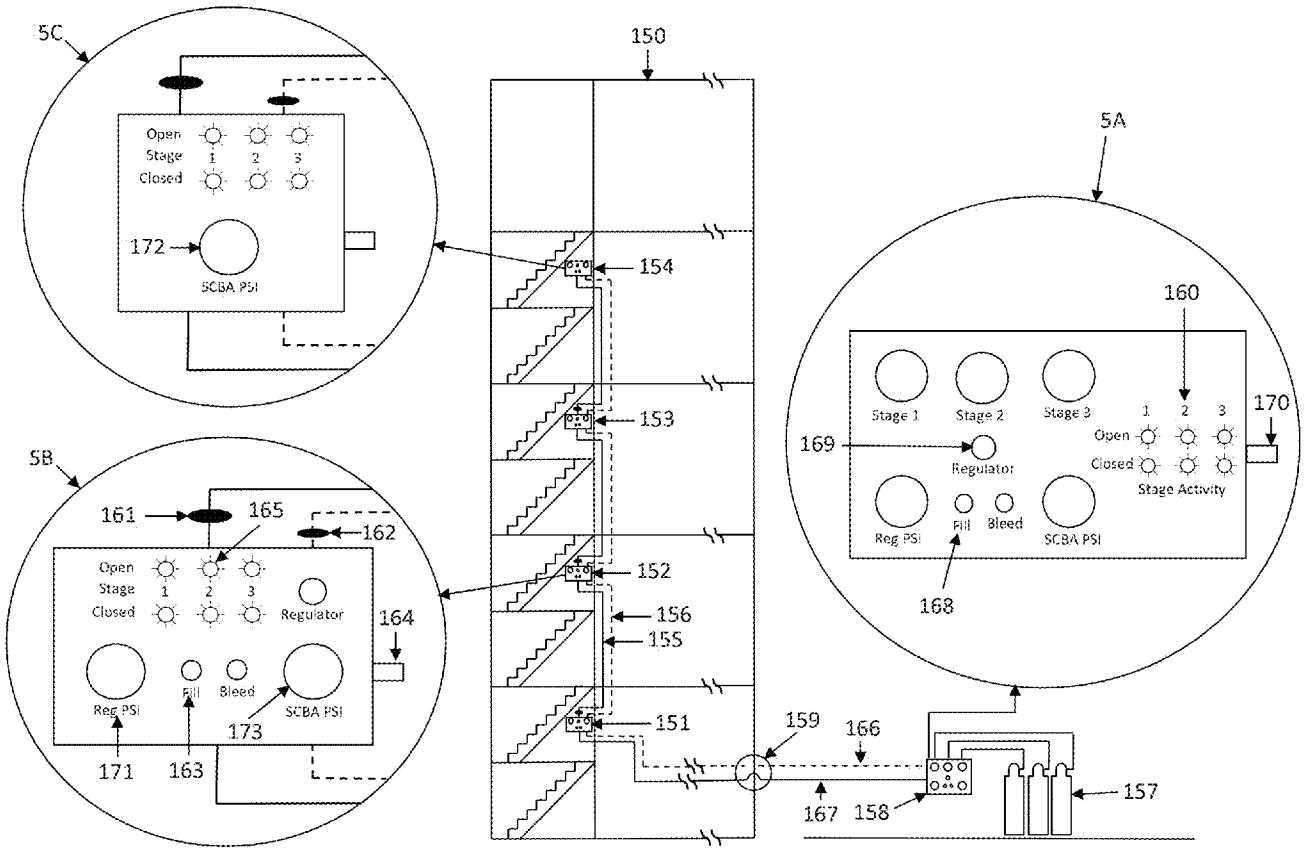
FIG. 5—Alternate to FIG. 4.

FIG. 5 is an alternate to FIG. 4.

This figure demonstrates the Multiple FIS (Flow Indicating Switch) based auto-cascade system when the applied use is to provide Auto-Cascade refilling of Fire Fighters SCBA using a "Firefighter Breathing Air Replenishment System" (FBARS) The FBARS requirements are set forth in the International Association of Plumbing and Mechanical Officials (IAPMO) documentation.

The Multiple-FIS (Flow Indicating Switch) controlled Auto-Cascading systems is similar to the Single FIS controlled Auto-Cascade system, as discussed in the FIG. 1 and FIG. 2 detailed descriptions, and is designed to function as intended when used in conjunction with the FBARS.

A stationary Multiple-Flow Indicating Switch (FIS) controlled Auto-Cascade used in conjunction with a bank of compressed gas storage cylinders may be permanently installed within a structure to provide compressed breathing air to the structures FBARS panel(s). An alternate to the permanently mounted FIS controlled Auto-Cascade system would be a Mobile (truck or trailer mounted) Flow Indicating Switch (FIS) controlled Auto-Cascade used in conjunction with a bank of compressed gas storage cylinders which would connect to the FBARS 159—Fire Department connection point on the structure to provide compressed breathing air to the structures FBARS panel(s).

FIS Location:

The FIG. 5 drawing design and operation is the same as that of FIG. 4 with two exceptions. In this design the FIS (Flow Indicating Switch) which is located within or in close proximity to, the 158—primary fill panel, is either removal or disabled and then a FIS has been installed in each FBARS panel.

In this design a FIS has been relocate within each of the 151, 152, 153 and 154—FBARS panels. The preferential location in the 5B—subdrawing would be downstream of the 172—pressure regulator or 163—fill valve and upstream of the 173—bleed valve. Preferential FIS location in the 5C—subdrawing would be upstream of the 172—SCBA pressure gauge. In this way the FIS controlled Auto-Cascade system will be much quicker to respond to flow due to the FIS being installed near the point of discharge into a SCBA cylinder.

Multiple FIS Operating Principle:

The FIS operates by the "Making" or "Breaking" of a circuit through which an electrical current or signal is passing. For clarity of this description, a simple electrical current will be used.

The FIS located in each FBARS panel will have a pair, one positive and one negative, of electrical signal wires which run in parallel with each other through the 156—wire bundle. The multiple pairs of FIS electrical signal wires will terminate within the 159—Fire Department connection point. Here the electrical signal wires shall be grouped into positive and negative sets and then connected to a single positive and negative terminal at the 159—Fire Department connection point. In this way the electrical current or signal from all FIS will be combined into a single pair of wires. These wires will then continue to the 158—primary fill panel ESM (Electronic Sequencing Module) through the 166—wire bundle. In this manner a single electrical current or signal from the multiple individual FIS will be obtained and transmitted to the ESM.

Note: It must be remembered that the only external events that will initiate and control the ESM sequencing program will be an electrical current or signal or lack of an electrical current or signal that is received from the total "group" of individual FIS which are installed in the FBARS panels.

Example of a Simple Multi-FIS Controlled Auto-Cascade System in Use:

An SCBA cylinder is being recharged at the 153—FBARS panel installed on the 3rd floor of the structure. The flow passing through the 153—FBARS panel FIS will complete or "Make" the electrical circuit and sending an electrical current or signal to the ESM thus activating the sequencing program. The initial electrical current or signal from the FIS will initiate the ESM Sequence-Fill program and the Auto-Cascade will open the 1st stage solenoid valve while simultaneously closing the 2nd and 3rd stage solenoid valves thus permitting compressed gas from the 1st stage storage cylinder to flow into the SCBA. When the differential pressure between the 1st stage fluid cylinder nears equalization with that of the SCBA cylinder which is being recharged and the flow of compressed gas through the FIS decreases to a predetermined minimal quantity, the FIS electrical circuit will "Break". When the electrical current or signal is lost, the ESM sequencing program will open the 2nd stage solenoid valve thus permitting compressed gas to flow from the 2nd stage storage cylinder into the SCBA cylinder which is being recharged.

Now, at this point, if a second SCBA cylinder is connected to the 151—FBARS panel which is installed on the 1st floor. The flow passing through the 151—FBARS panel FIS will complete the electrical circuit and sending an electrical current or signal to the ESM. However, since all FIS wire pairs are installed in parallel and the ESM is already receiving the electrical current or signal from the 153—FBARS panel FIS, the ESM will remain locked into the 2nd stage of the fill sequence and will not sequence up and open the 3rd stage solenoid valve until flow through both FIS drops below a predetermined quantity and the electrical current or signal from both FIS ceases.

Since the compressed gas will flow towards the point of least resistance, the compressed gas discharge from the 2nd stage fluid cylinder will flow into the SCBA cylinder which has the lowest pressure. The compressed gas will continue to flow into this cylinder until the pressure equalizes with that of the next higher pressure SCBA cylinder. At this point the compressed gas will flow into both SCBA cylinders simultaneously and at an equal rate.

NOTE: Due to the secondary check valve function of the FIS, no compressed gas from the highest pressure SCBA cylinder which is connected to the system, will be lost due to upstream flow into the FBARS.

This flow will continue until the flow through both FIS decrease to a predetermine minimal level at which time electrical current or signal going to the ESM is stopped by both FIS. When this event occurs, the ESM shall continue through its normal sequence-Fill program until the desired SCBA pressure is achieved or the recharge operation is stopped by one or both personnel who are performing the individual SCBA recharge operations.

NOTE: If only one of the SCBA recharging operations is stopped, the recharge operation of the second SCBA cylinder will automatically continue through the remainder of the ESM recharging sequence.

Basic Component Description:

In the FIG. 5 design, the compressed gas supply needed at each of the 151, 152 and 153—FBARS panels will originate at the 158—primary fill panel. The flow exiting the 158—primary fill panel will pass through the 167—pipe or tube and into the 155—compressed gas distribution pipe or tube at the 159—Fire Department connection point.

The individual 151, 152, 153 and 154—FBARS panels are interconnected with the 155—compressed gas distribution pipe or tubing. The FBARS panels may be equipped with an optional 161—isolation block valve which, when closed, will isolate the compress gas feed to all FBARS panels which are located above or distal to the 161—isolation block valve. The FBARS panels are equipped with a 156—wire bundle which has the primary function of transmitting a electric current or signal from the individual FIS to the 158—primary fill panel ESM (Electronic Sequencing Module) which in turn will control the auto-cascade discharge of the various fluid cylinder stages.

As an option, additional wires will be included in the 156—wire bundle and will be used to transmit an electric current or signal from the 158—primary fill panel which will enable the individual FBARS panel 165—visual indication of stage activity lights or readout to mimic that of the 158—primary panel 160—visual indication of stage activity lights or readout. An optional 162—wire bundle disconnect should be installed on each of the FBARS panels which, when opened, will isolate the electrical feed to all FBARS panels which are located above or distal to the 162—wire bundle disconnect.

The 5A—subdrawing show expanded details of the 118—primary fill panel while the 4B and 4C—subdrawings show expanded details of two different styles of individual FBARS panels.

FBARS Function when Used with a Mobile Multiple FIS Controlled Auto-Cascade System:

While both the stationary permanently installed or "Fix Mount" and the Mobile FIS controlled Auto-Cascade system functions identically when used in conjunction with the FBARS, in the following example a mobile type cascade will be used.

Example: Multi-FIS Controlled Auto-Cascade System when Used Under Emergency Conditions A fire has occurred on the 4th floor of a 5 story structure. A Mobile FIS controlled Auto-Cascade system has been brought in to supply compressed breathing air to the structures FBARS.

The 166—wire bundle and the 167—pipe or tubing supplying compressed gas from the mobile cascade systems 158—primary fill panel are attached to their corresponding 156—wire bundle and 155—compressed gas distribution pipe or tubing at the structures 159—Fire Department connection point.

If Fire Fighters or Rescue Personnel arriving on the 3rd floor of the structure suspect that the 154—FBARS panel, 155—FBARS compressed gas distribution pipe or tubing and/or the 156—wire bundle on the 4th floor has been damaged by fire, explosion or other malfunction, the Fire Fighter(s) will close the FBARS 161—isolation valve and open the 162—wire bundle disconnect which is located directly above the 153—FBARS thus isolating the FBARS components which are located on the 4th floor. The Fire Fighter or Rescue Personnel then notify the Incident Commander that the 150—structure FBARS is ready for operation. The Incident Commander then notifies the Cascade system operator who will then open the 158—primary fill panel 168—fill valve.

Opening the 158—primary fill panel 168—fill valve will pressurize the 155—compressed gas distribution pipe or tube via the 167—pipe or tubing thus pressurizing the 151, 152 and 153—FBARS panels. At the same time of pressurization, the optional 156—wire bundle will receive an electric current or signal from the 158—primary fill panel via the 166—wire bundle which will enable the individual 151, 152 and 153—FBARS panels 165—visual indication of stage activity lights or readout to mimic that of the 158—primary panel 160—visual indication of stage activity lights or readout.

Since all FBARS panels have FIS installed in each and no flow is passing through any of the FIS, the 158—primary fill panel ESM will initiate into Stand-By mode and open all of the compressed gas storage cylinders solenoid valves.

NOTE: At the time of system initiation the 158—primary fill panel 160—visual indication of stage activity lights or readout will "mimic" the entire "group" of FBARS panels 165—visual indication of stage activity lights or readout. If the 158—primary fill panel 160—visual indication of stage activity lights or readout indicates a compressed gas flow from one of more individual stage(s) BEFORE Fire Fighting or Rescue Personnel have entered the structure, the 158—primary panel operator will be able to quickly determine that damage may have occurred to one or more of the FBARS components.

When a Fire Fighter within the fire structure needs to recharge their Self Contained Breathing Apparatus (SCBA), the SCBA cylinder(s) is attached to the 164—SCBA connection point of any of the active/operational FBARS panels. NOTE: The connection method used should comply with industry accepted methods such as a "quick fill" connection, a commercially fabricated "Fill enclosure" or the Fire Fighters SCBA "RIT" (Rapid Intervention Team) or "RIC" (Rapid Intervention Crew) fittings, if the situation so necessitates.

When a SCBA cylinder is connected to a FBARS panel 164—SCBA connection point and the 163—fill valve is opened, compressed gas from the 155—compressed gas distribution pipe or tube will begin to flow into the SCBA cylinder(s) which is being recharged. The compressed gas flow through the FIS, which is installed the FBARS fill panel being used, will initiate the ESM which will then go into "Sequence-Fill" mode. At this point the FIS controlled Auto-Cascade shall operate as described in the FIG. 1 and FIG. 2 detailed descriptions of this document.

NOTE 1: The Fire Fighter performing SCBA fill operation using any of the FBARS panel may use the optional 165—visual indication of stage activity to determine if other FBARS panels are in use and, if so, which stage the FIS controlled Auto-Cascade is in at any specific point in time. This information combined with the FBARS panel 171—regulated pressure gauge and the 173—SCBA pressure gauge will provide vital information to the Fire Fighter performing the SCBA recharge operation. The visual indication of stage activity will also visible to the operator that is monitoring the 158—primary fill panel 160—visual indicator of stage activity. This information will help the operator of the 158—primary panel determine the approximate numbers of SCBA recharges which are taking place and the total rate of breathing air consumption. This combined information will assist the 158—primary panel operator in determining whether there is a sufficient quantity of compressed gas on scene for the duration of the incident or if additional compressed gas will be required to complete the operation.

NOTE 2: Since the active/operational 151, 152 and 153—FBARS panels function as a remote extension of the 158—primary fill panel. The 118—primary fill panel operator's sole purpose will be to monitor the system and initiate either the Back-Fill or Hybrid Priority-Fill procedure in the event that the 157—fluid cylinder pressures are depleted to a predetermined pressure.

Optional FBARS Panel Design:

NOTE 1: The 4C—subdrawing demonstrate an alternate FBARS panel design where the pressure regulator has been omitted. When this design of FBARS panel is used, the FBARS panel discharge pressure is set solely by use of the 158—primary panel 169—pressure regulator.

NOTE 2: If FBARS panels are used in conjunction with a Fire Fighters SCBA "RIT" (Rapid Intervention Team) or "RIC" (Rapid Intervention Crew) fittings and local codes and regulations permit, the FBARS panel "Fill" and "Bleed" valve may be omitted.

Figure 6:
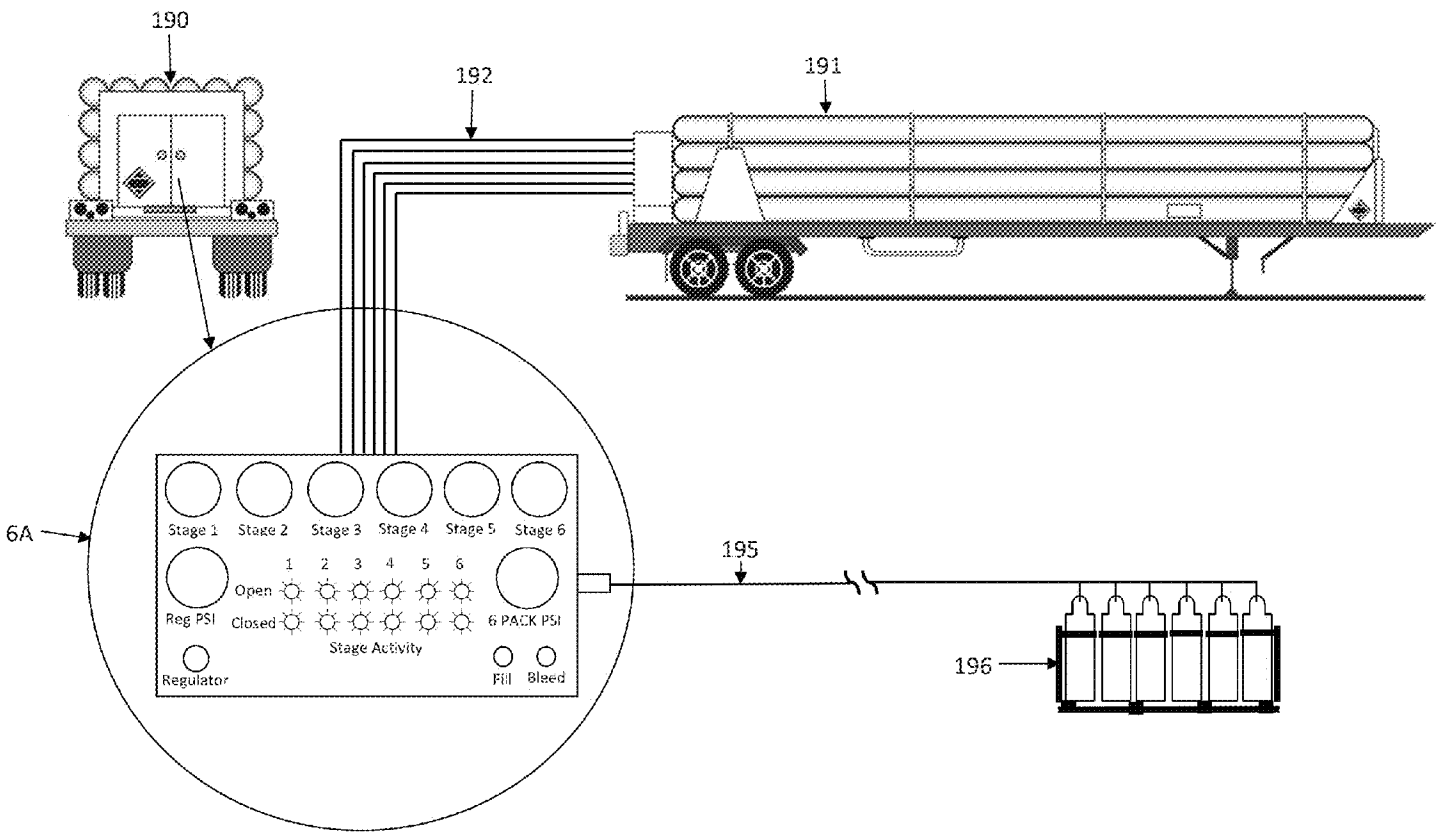
FIG. 6—Single flow indicating switch auto cascade system.

FIG. 6 is a single flow indicating switch auto cascade system.

FIG. 6 demonstrates the use of the Single FIS (Flow Indicating Switch) based auto-cascade system, as described in FIG. 4, however, the applied use in this figure is to provide Auto-Cascade refilling of one or more multiple cylinder storage bank(s), such as a 6 pack, located at a distance remote to a tube trailer. The breathing air 6 pack is then used for recharging SCBA cylinders, diving SCUBA cylinders, providing air to SAR (supplied air respirators) and/or providing compressed air for pneumatically operated tools. It must be remembered that this configuration is not limited to simple compressed air but can be used with any type of compressed gas transfer such as nitrogen, H2S or SO2 just to name a few.

For the purpose of FIG. 6, the three stage valve bodies discussed in FIGS. 1 and 2, have been used and 3 additional stages have been added in accordance with FIG. 3 making this figure demonstration a 6 stage FIS Auto-Cascade system.

The sub-drawing 6A—FIS Auto-Cascade valve assembly panel is located inside the 190—tube trailer rear valve compartment and is connected to the tube trailer 191—individual high pressure tubes via the 192—tubing/pipes.

The connection 6A—FIS Auto-Cascade valve assembly panel to available tubes may be on a 1 to 1 basis or multiple 191—tubes could be connected to a single valve.

When multiple 191—tubes are connected to an individual stage valve located inside the 6A—FIS Auto-Cascade valve assembly panel it may be done in a descending order beginning with stage 1 or the lowest pressure bank. An example of multiple 191—tubes connected to each individual 6A—FIS Auto-Cascade valve assembly panel stage valves via the 192—tubing/pipes could be eight 191—tubes connected to the 6A—FIS Auto-Cascade valve assembly panel stage 1 valve, six 191—tubes connected to the 6A—FIS Auto-Cascade valve assembly panel stage 2 valve and so on.

Pressure from the 191—individual high pressure tubes are directed by the 6A—FIS Auto-Cascade valve assembly panel individual valves into the 195—discharge tub/piping. The 195—discharge tube/pipe transports the compressed gas flow to a remote location where it is connected to the 196—compressed gas storages cylinders.

In this way the 6A—FIS Auto-Cascade valve assembly panel automatically cascade refills, at an unlimited distance, the remote 196—compressed gas storage cylinders via a single 195—discharge tube/pipe.

While these embodiments have been described with emphasis on the embodiments, it should be understood that within the scope of the appended claims, the embodiments might be practiced other than as specifically described herein.

What is claimed is:

1. A system for the automatic recharging of at least one fluid cylinder comprising:

a) at least one fluid cylinder;

b) at two fluid storage cylinders;

c) solenoid valves in communication with each of the at least two fluid storage cylinders;

d) a flow indicating switch for detecting a flow of fluid; and e) an electronic sequencing module in electronic communication with the flow indicating switch, wherein the electric sequencing module uses a signal from the flow indicating switch to operate the solenoid valve to control an order and a timing of discharge from the at least two fluid storage cylinders into the at least one fluid cylinder.

2. The system of claim 1, wherein the solenoid valve is electric, electric over pneumatic, or electric over hydraulic.

3. The system of claim 1, wherein the flow indicating switch which emits an electronic signal when the flow of fluid exceeds a predetermined flow quantity.

4. The system of claim 1, wherein the electronic sequencing module maximizes the number of times the at least one fluid cylinder is recharged by the at least two fluid storage cylinders.

5. The system of claim 1, wherein the electronic sequencing module provides a visual or audible reference indicating whether the solenoid valve is open or closed.

6. The system of claim 1, further comprising a back-up power source for providing power in the event of a power failure, wherein the back-up power source is in communication with a means of charging the back-up power source.

7. The system of claim 1, wherein at least a portion of the electronic sequencing module is located remotely to the at least one fluid cylinder.

8. The system of claim 1, wherein a plurality of fluid cylinders are supplied by a single supply line.

9. The system of claim 1, wherein at least a portion of the flow indicating switch is located remotely to the at least one fluid cylinder.

10. The system of claim 1, further comprising a manually operated valve for use in the event of a mechanical or electrical failure.

11. The system of claim 1, further comprising a compressor for providing fluid, wherein the electronic sequencing module directs the fluid into the at least one fluid cylinder until a predetermined fluid level, a fluid volume, or a fluid pressure is reached, at which time the electronic sequencing module then directs the fluid into the at least two fluid storage fluid cylinders.

12. The system of claim 1, further comprising a compressor for providing fluid, wherein the electronic sequencing module directs a portion of the fluid into the at least one fluid cylinder while simultaneously directing a portion of the fluid into the fluid storage cylinder with the lowest pressure of the at least two fluid storage cylinders followed by the next higher pressure cylinder of the at least two fluid storage cylinders.

13. The system of claim 1, further comprising a compressor for providing fluid, wherein the electronic sequencing module directs a portion of the fluid into the at least one fluid cylinder while simultaneously directing a portion of the fluid into the cylinder with the highest pressure of the at least two fluid storage cylinders followed by the next lower pressure cylinder of the at least two fluid storage cylinders.

14. The system of claim 1, wherein at least a portion of the system is attached to a firefighter breathing air replenishment system.

15. A method for automatically recharging at least one fluid cylinder comprising:

a) using a at least two fluid storage cylinders to supply a fluid to at least one fluid cylinder;
b) using a flow indicating switch to detect a flow of fluid;
c) generating an electronic signal with the flow indicating switch; and
d) communicating the electronic signal to an electronic sequencing module, wherein the electronic sequencing module operates solenoid valves allowing fluid to flow from the at least two fluid storage cylinders to the at least one fluid cylinder.

16. The method of claim 15, further comprising using a manually operated valve in the event of a mechanical or electrical failure.

17. The method of claim 15, wherein the electronic sequencing module or the flow indicating switch is located remotely from the at least one fluid cylinder.

* * * * *